United States Patent [19]

Fujitani

[11] Patent Number: 5,045,013

[45] Date of Patent: Sep. 3, 1991

[54] AIR-CUSHION VEHICLE TOY

[75] Inventor: Takashi Fujitani, Tokyo, Japan

[73] Assignee: Kabushiki Kaisha Gakushu Kenkyusha, Japan

[21] Appl. No.: 553,458

[22] Filed: Jul. 17, 1990

[30] Foreign Application Priority Data

Apr. 23, 1990 [JP] Japan ..... 2-43365

[51] Int. Cl.[5] ..... A63H 33/40; A63H 29/02; A63H 29/22

[52] U.S. Cl. ..... 446/179; 446/462; 446/484; 446/57

[58] Field of Search ..... 446/179, 178, 176, 34, 446/36, 37, 57, 58, 484, 461, 462, 457, 485

[56] References Cited

U.S. PATENT DOCUMENTS

| | | | |
|---|---|---|---|
| 3,628,284 | 12/1971 | Saulakis et al. | 446/462 |
| 3,908,305 | 9/1975 | Schreeder | 446/57 X |
| 3,937,911 | 2/1976 | Mabuchi et al. | 446/57 X |
| 3,949,517 | 4/1976 | Reiner et al. | 446/485 X |
| 4,249,334 | 2/1981 | Goldfarb et al. | 446/157 |
| 4,468,884 | 9/1984 | Goldfarb et al. | 446/462 |
| 4,507,097 | 3/1985 | Klawitter | 446/484 X |
| 4,511,343 | 4/1985 | Goldfarb et al. | 446/457 X |
| 4,547,166 | 10/1985 | Goldfarb et al. | 446/462 X |
| 4,684,355 | 8/1987 | Urakawa et al. | 446/457 X |
| 4,964,835 | 10/1990 | Suto | 446/179 X |

FOREIGN PATENT DOCUMENTS

| | | |
|---|---|---|
| 55-98394 | 7/1980 | Japan . |
| 56-56394 | 5/1981 | Japan . |
| 56-56395 | 5/1981 | Japan . |
| 56-176796 | 12/1981 | Japan . |
| 56-176797 | 12/1981 | Japan . |
| 58-188094 | 12/1983 | Japan . |
| 63-29595 | 2/1988 | Japan . |

*Primary Examiner*—Robert A. Hafer
*Assistant Examiner*—D. Neal Muir
*Attorney, Agent, or Firm*—Leydig, Voit & Mayer

[57] ABSTRACT

An air-cushion vehicle toy [1] includes a first motor [3*b*] for driving a propeller fan [3*a*], a second motor [4*b*] for driving a hovering fan [4*a*], and a body [1*a*] detachably mounted on a chassis [1*b*], on which a power supply [5*a*] is supported, and covering the upper surface of the chassis [1*b*] with various components supported thereon. The air-cushion vehicle toy [1] further includes a power cutoff mechanism [5] for breaking a power supply circuit to deenergize the first and second motors when the body [1*a*] is removed from the chassis [1*b*].

7 Claims, 5 Drawing Sheets

AIR-CUSHION VEHICLE TOY

BACKGROUND OF THE INVENTION

1. Field of the Invention

The present invention relates to an air-cushion vehicle toy.

2. Description of the Relevant Art

Air-cushion vehicle toys such as Hovercraft toys are supported aloft by a downward air thrust and propelled forward by a rearward air thrust. Such an air-cushion vehicle toy has a base comprising a chassis which supports thereon a propelling fan, a drive motor for the propelling fan, a hovering fan, a drive motor for the hovering fan, a battery as a power supply for the drive motors, and other members. These components mounted on the chassis are covered with a body mounted on the chassis. The body has an air inlet and an air outlet, each in the form of slits or a hole with a grid. To produce efficient propelling forces, the propelling fan generally comprises a large-size propeller fan of the exposed type. The lower surface of the chassis has a skirt extending along the peripheral edge thereof, for guiding the air thrust from the hovering fan downwardly.

When the body is removed from the chassis for battery replacement or other servicing, the battery and other components are exposed. If the control switch is turned on by mistake at this time, or if a new battery is connected while the control switch is being turned on, then the propeller fan is energized, causing the toy to move around. When this happens, it not easy to turn off the control switch.

The propeller fan and the hovering fan are directly connected to the shafts of their motors, respectively, and the motors are installed on the chassis. Each of the motors is installed on the chassis by an attachment seat on the chassis and an attachment member which holds the motor down on the attachment seat. The attachment member has both ends screwed to the chassis. The motors can be mounted on or dismounted from the chassis when the attachment members are fastened or released by tightening or loosening the screws.

The structure by which the motors are installed on the chassis thus includes small elements such as the screws and their washers, and hence is composed of a large number of parts, can only be assembled in a relatively complex process and over a long period of time, and, as a result, is relatively highly costly. If the existing motors are to be replaced with motors of higher power requirements in order to modify the air-cushion vehicle toy, then tools such as screwdrivers are needed to tighten and loosen the screws, and the screws and washers tend to be lost.

With the conventional air-cushion vehicle toy, the air thrust which is directed downwardly by the skirt does not produce well-balanced floating or hovering forces. Therefore, when the air-cushion vehicle toy is in operation, it is apt to be tilted, bringing one side of the toy into contact with the surface of water underneath the toy, so that the toy cannot run as desired, or the toy tends to lose stability when lifted aloft.

The present invention has been made in an effort to effectively solve the aforesaid problems of the conventional air-cushion vehicle toy.

SUMMARY OF THE INVENTION

It is an object of the present invention to provide an air-cushion vehicle toy which has means for preventing motors from being energized by mistake when a body is removed from a chassis for battery replacement or other servicing.

Another object of the present invention is to provide an air-cushion vehicle toy which has a motor attachment structure that is constructed of a reduced number of components, can easily be assembled, and is low in cost.

Still another object of the present invention is to provide an air-cushion vehicle toy which produces a downward air thrust directed by a skirt, thereby generating well-balanced lifting forces, so that the air-cushion vehicle toy is prevented from being tilted when lifted aloft.

According to he present invention, there is provided an air-cushion vehicle toy comprising a chassis, a propeller fan mounted on the chassis, a first motor mounted on the chassis, for driving the propeller fan, a hovering fan mounted on the chassis, a second motor mounted on the chassis, for driving the hovering fan, a power supply mounted on the chassis and selectively connectable to the first motor and the second motor, for energizing the first motor and the second motor, the power supply and the first and second motors constituting a power supply circuit, a body detachably mounted on the chassis in covering relation to the propeller fan, the first motor, the hovering fan, the second motor, and the power supply, and a power cutoff mechanism disposed in the power supply circuit, for breaking the power supply circuit to de-energize the first and second motors, when the body is removed from the chassis, and for making the power supply circuit when the body is attached to the chassis.

The air-cushion vehicle toy further includes a first motor attachment structure by which the first motor is installed on the chassis, and a second motor attachment structure by which the second motor is installed on the chassis, the first motor attachment structure comprising a first holder frame mounted on the chassis and accommodating the first motor, the first holder frame having at least one recess, and a first attachment attached to the first holder frame to secure the first motor and having at least one resilient finger which resiliently engages in the recess in the first holder frame, the second motor attachment structure comprising a second holder frame mounted on the chassis and accommodating the second motor, the second holder frame having at least one recess, and a second attachment attached to the second holder frame to secure the second motor and having at least one resilient finger which resiliently engages in the recess in the second holder frame.

The air-cushion vehicle toy also has a skirt mounted on a lower surface of the chassis, the skirt defining a pressure space for ejecting downwardly of the toy part of air under pressure delivered by the hovering fan, the skirt having a plurality of holes for ejecting the remainder of the air under pressure delivered by the hovering fan, the holes being defined in a lower surface thereof and arranged in surrounding relation to the pressure space when viewed in plan.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
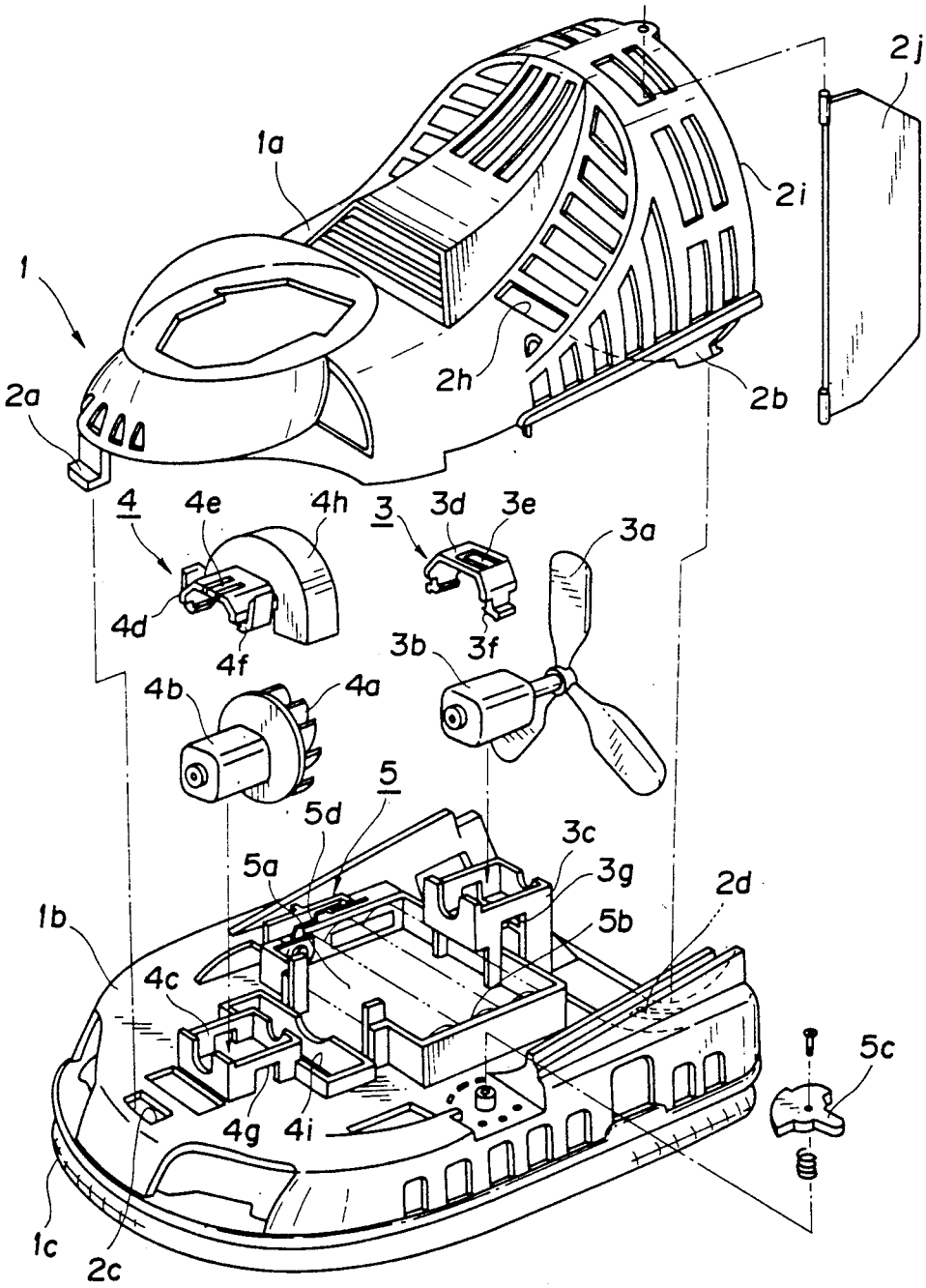
FIG. 1 is an exploded perspective view of an air-cushion vehicle toy according to a preferred embodiment of the present invention.

As shown in FIG. 1, an air-cushion vehicle toy, generally designated by the reference numeral 1, according to preferred embodiment of the present invention generally comprises a chassis 1*b* serving as a toy base, a body 1*a* covering the upper surface of the chassis 1*b*, and a skirt 1*c* attached to the lower surface of the chassis 1*b*.

The body 1*a* has two downward flexible fingers 2*a*, 2*b* on respective front and rear ends thereof. The chassis 1*b* has holes 2*c*, 2*d* defined in respective front and rear ends thereof for receiving the respective fingers 2*a*, 2*b* therein. An air inlet hole 2*h* in the form of slits is defined in upper and opposite side surfaces of a rear portion of the body 1*a*, and an air outlet hole 2*i* having grids is defined in a rear surface of the rear portion of the body 1*a*. A laterally swingable steering rudder 2*j* is attached to the rear end of the body 1*a* behind the air outlet hole 2*i*.

Figure 2:
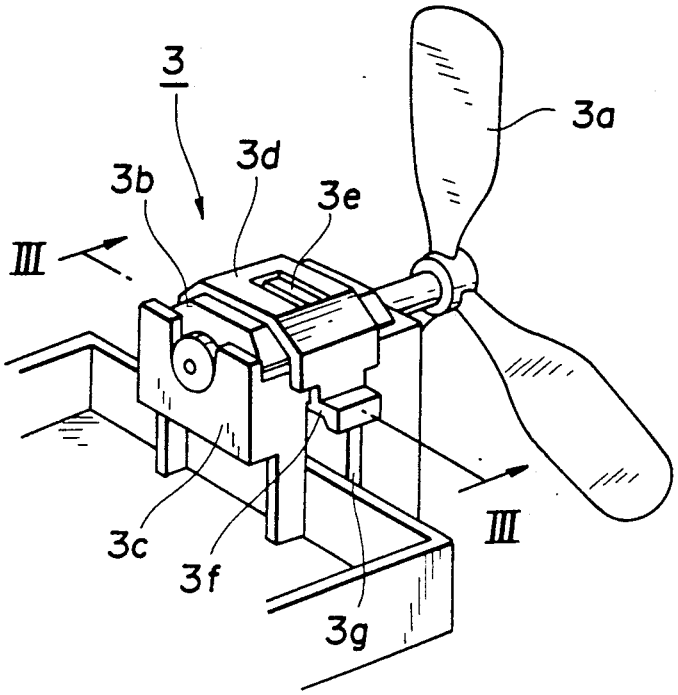
FIG. 2 is a perspective view of an attachment for a motor for a propeller fan in the air-cushion vehicle toy shown in FIG. 1.
Figure 3:
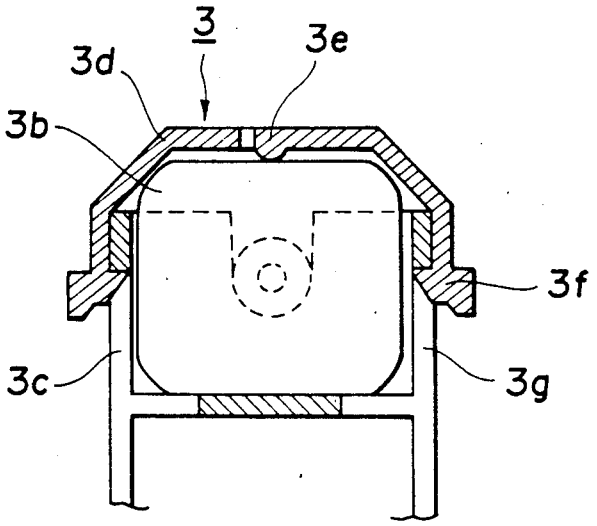
FIG. 3 is a cross-sectional view taken along line III—III of FIG. 2.
Figure 4:
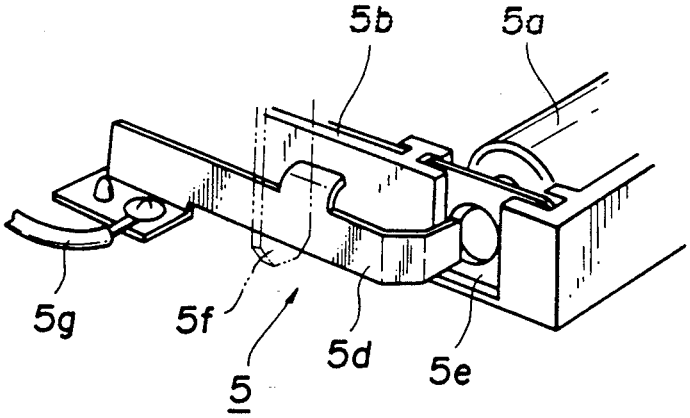
FIG. 4 is a perspective view of a power cutoff mechanism.
Figure 5:
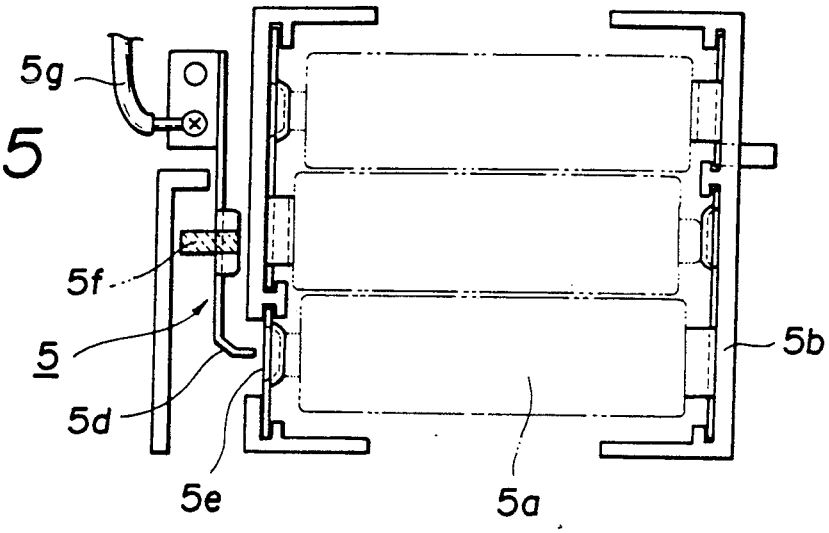
FIG. 5 is a plan view of the power cutoff mechanism.

A motor 3*b* with a propeller fan 3*a* fixed to its rotatable shaft is mounted on a rear portion of the chassis 1*b* by an attachment structure 3 which comprises a holder frame 3*c* that accommodates the motor 3*b* therein and an attachment 3*d*, the holder frame 3*c* being installed on the chassis 1*b*. As shown in FIGS. 2 and 3, the attachment 3*d*, which is made of a flexible material, has an inverted channel-shaped cross section. The attachment 3*d* has a central tongue which includes a tooth 3*e* on its lower surface, which is resiliently held against an upper surface of the motor 3*b*, holding the motor 3*b* against the holder frame 3*c*. The attachment 3*d* also has a pair of laterally spaced resilient fingers 3*f* on the lower ends of its laterally spaced legs, the fingers 3*f* resiliently engaging respectively in recesses 3*g* that are defined in lateral side walls of the holder frame 3*c*.

A hovering fan 4*a* for producing a downward air thrust is mounted on the rotational shaft of a motor 4*b* which is installed on a front portion of the chassis 1*b*.

The motor 4*b* is installed on the chassis 1*b* by an attachment structure 4 which comprises a holder frame 4*c* that accommodates the motor 4*b* therein and an attachment 4*d*, the holder frame 3*c* being installed on the chassis 1*b*. The attachment 4*d* is made of a flexible material and has a central tongue which includes a tooth 4*e* on its lower surface, which is resiliently held against an upper surface of the motor 4*b*, holding the motor 4*b* against the holder frame 4*c*. The attachment 4*d* also has a pair of laterally spaced fingers 4*f* on the lower ends of its laterally spaced legs, the fingers 4*f* engaging respectively in recesses 4*g* that are defined in lateral side walls of the holder frame 4*c*. In order not to adversely affect the stability of the toy 1 when it hovers, the hovering fan 4*a* comprises a multiblade fan whose axis is oriented horizontally. The fan 4*a* is covered with a casing 4*h* which is integral with the attachment 4*d* and fittingly joined to an air duct 4*i* which is defined in the chassis 1*b* behind the holder frame 4*c* and communicates with the space below the chassis 1*c*.

The chassis 1*b* has a battery holder 5*b* for holding batteries 5*a*. A control switch 5*c* is mounted on one side of the chassis 1*b* laterally of the battery holder 5*b*, the control switch 5*c* having a knob projecting laterally outwardly from the chassis 1*b*. The control switch 5*c* can be angularly shifted to one, at a time, of three positions, i.e., "STOP", "HOVER", and "HOVER/RUN".

Figure 6A:
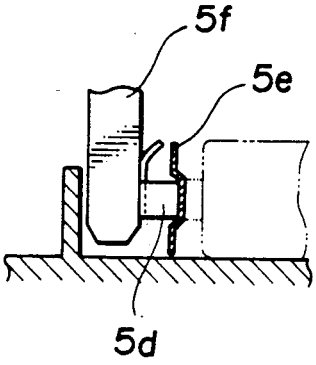
FIGS. 6A and 6B are side elevational views of the power cutoff mechanism.
Figure 6B:
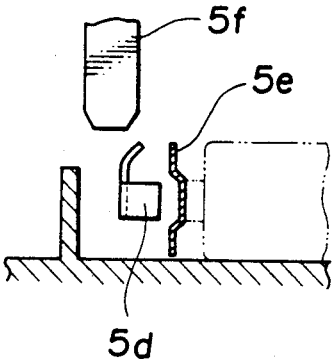

As shown in detail in FIGS. 4, 5, 6A, and 6B, the toy 1 has a power cutoff mechanism 5, which comprises a fixed contact 5*e* of the battery holder 5*b*, a movable contact 5*d* positioned near a side of the battery holder 5*b* and normally spaced from the fixed contact 5*e*, and an engaging member end 5*f* projecting inside the body 1*a* for engaging the movable contact 5*d*. The movable contact 5*d* has an end fastened to the chassis 1*b* and electrically connected to a power wire 5*g*. The power wire 5*g* is connected through the control switch 5*c* to the motors 3*b*, 4*b*, thereby constituting a power supply circuit. As shown in FIG. 6A, when the body 1*a* is attached to the chassis 1*b*, bringing the engaging member end 5*f* into engagement with the movable contact 5*d*, the movable contact 5*d* contacts the fixed contact 5*e*, making the power supply circuit. When the body 1*a* is removed from the chassis 1*b*, lifting the engaging member end 5*f* out of engagement with the movable contact 5*d*, the movable contact 5*d* is shifted out of contact with the fixed contact 5*e*, braking the power supply circuit, as shown in FIG. 6B.

Figure 7:
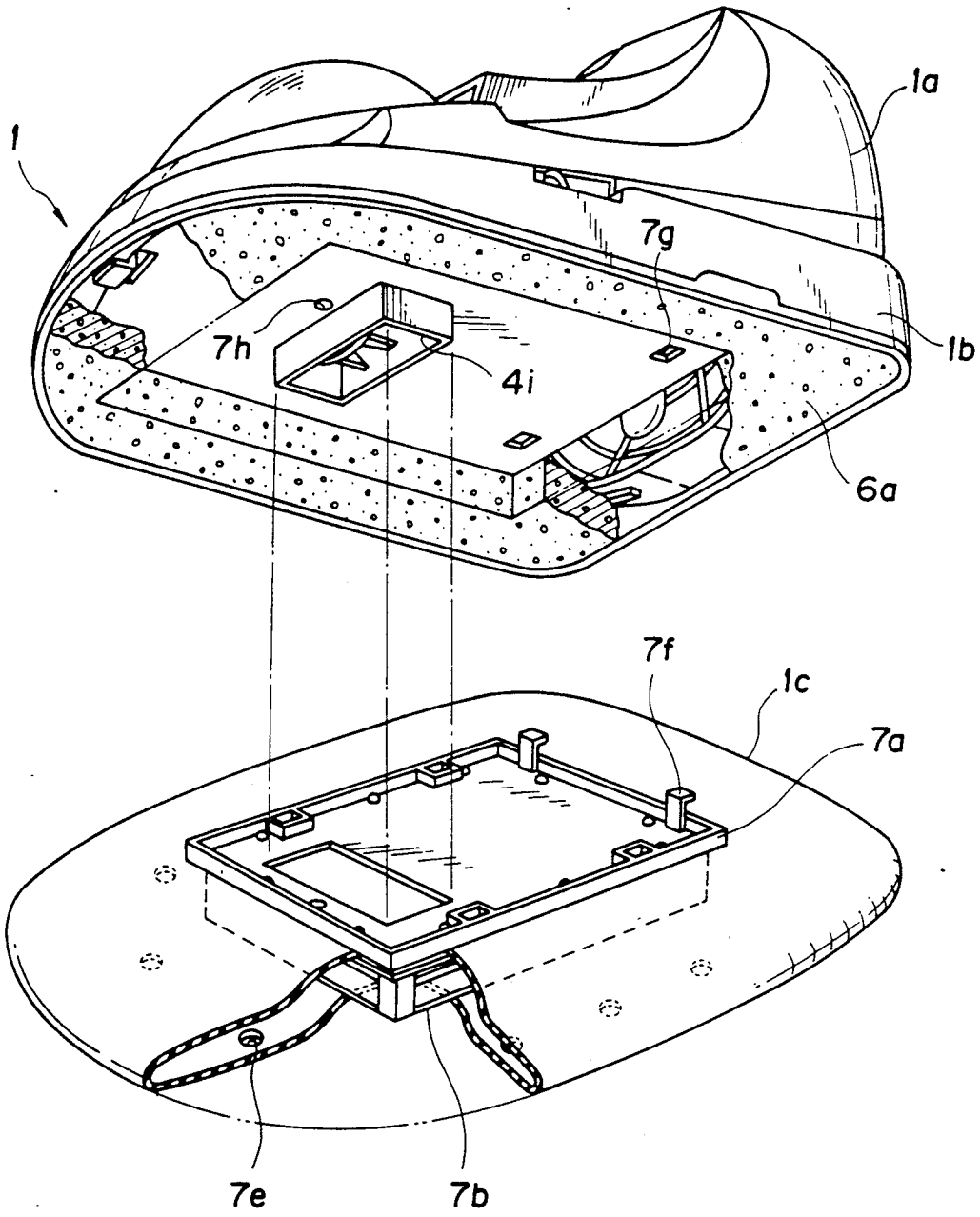
FIG. 7 is an exploded perspective view of a skirt of the air-cushion vehicle toy.
Figure 8:
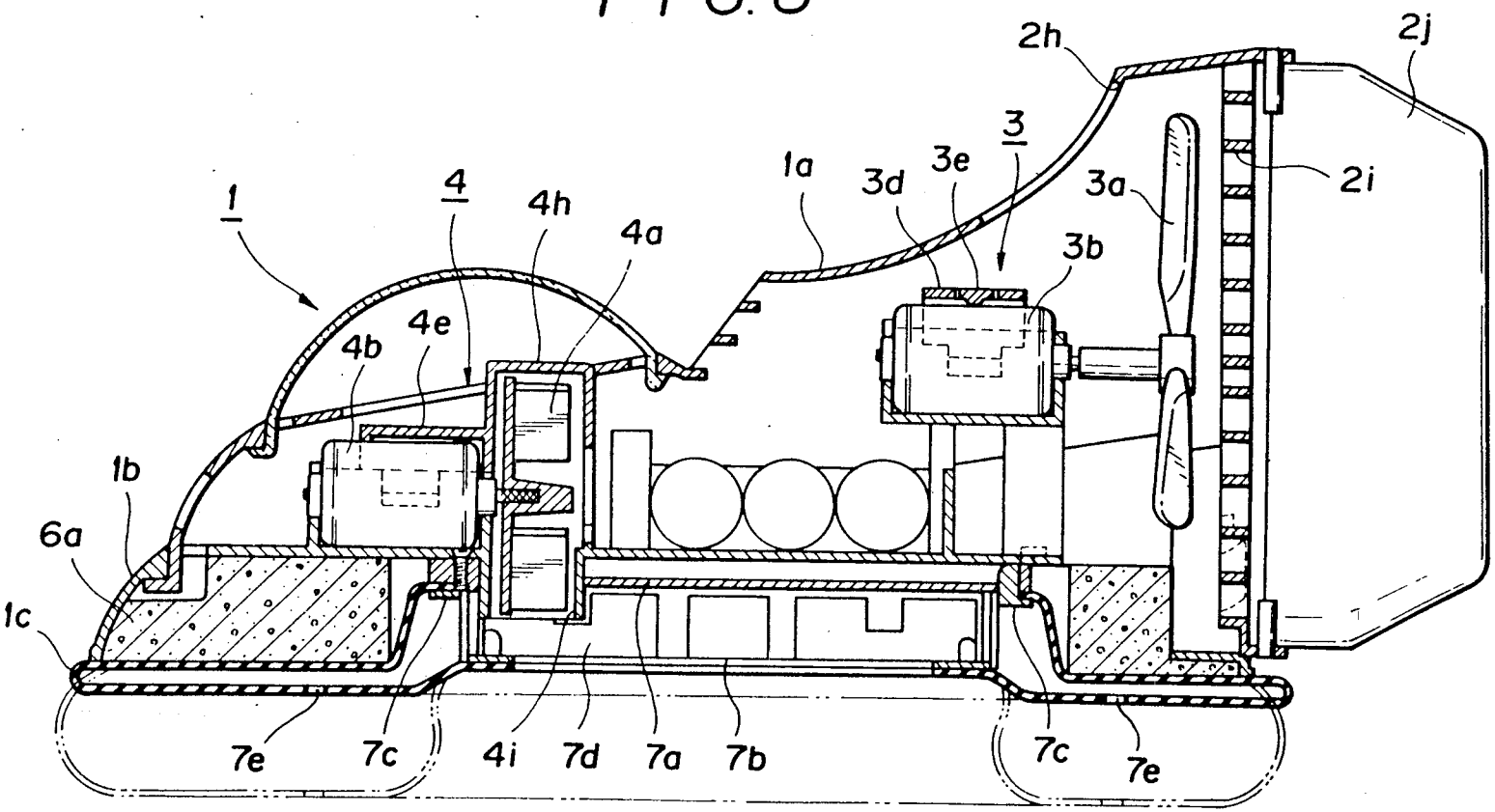
FIG. 8 is a vertical cross-sectional view of the air-cushion vehicle toy.

As illustrated in FIGS. 7 and 8, a float 6*a* made of polystyrene foam is fixedly attached to the peripheral edge of the lower surface of the chassis 1*b*. The float 6*a* serves to float the toy 1 on water and keep the toy 1 horizontal in the floating position.

A skirt 1*c* is attached to the lower surface of the chassis 1*b* through a substantially rectangular attachment plate 7*a*. The skirt 1*c* is positioned beneath the float 6*a*, and is in the form of a bag of thin film made of soft resin.

The attachment plate 7*a* has a lower frame 7*b* on its lower side. The skirt 1*c* has upper and lower central opening edges which are vertically spaced from each other and hermetically joined respectively to a lower peripheral edge of the attachment plate 7*a* and a lower peripheral edge of the lower frame 7*b*, thereby defining a rectangular annular inner opening 7*c* (FIG. 8). The lower frame 7*b* has an open lower side, defining an open space 7*d* below the attachment plate 7*a*. When viewed in plan, the space 7*d* contains the battery holder 5*b*, and hence the center of gravity of the toy 1. The air duct 4*i* which projects downwardly through the chassis 1*b* and serves as an air flow guide, extends through the attachment plate 7*a* into the inner opening 7*c* within the skirt 1*c*.

The skirt 1*c* has a number of small holes 7*e* defined in a lower layer thereof and spaced radially outwardly from the space 7*d* in surrounding relation thereto when viewed in plan. Air which is delivered into the skirt 1*c* by the hovering fan 4*a* is ejected downwardly from the small holes 7*e*. The skirt 1*c*, the attachment plate 7*c*, and the lower frame 7*b* are constructed as a unitary structure. Therefore, the skirt 1*c* is affixed to the chassis 1*b* when fingers 7*f* of the attachment plate 7*a* engage in holes 7*g* in the chassis 1*b* and the attachment plate 7*a* is fastened to the chassis 1*b* by a screw (not shown) threaded into an attachment hole 7*h* which is defined in the front portion of the chassis 1*b*.

Operation of the air-cushion vehicle toy 1 thus constructed will be described below.

When the front and rear fingers 2*a*, 2*b* of the body 1*a* (FIG. 1) are fitted respectively in the front and rear holes 2*c*, 2*d* in the chassis 1*b*, the body 1*a* is fixed to the chassis 1*b*, thus covering the upper surface of the chassis 1*b*. The body 1*a* can be detached from the chassis 1*b* when the fingers 2*a*, 2*b* are removed from the holes 2*c*, 2*d*.

When the fingers 3*f* of the attachment 3*d* of the attachment structure 3 engage respectively in the recesses 3*g* in the holder frame 3*c*, the tooth 3*e* (FIG. 3) resiliently presses down the motor 3*b*, which is thus fixed in place. At the time of installing the motor 3*b* in the holder frame 3*c*, the motor 3*b* is oriented with respect to terminals (not shown) on the bottom of the holder frame 3*c*, and then the attachment 3*d* is placed over the motor 3*b* and pressed against the motor 3*b*. In this manner, the motor 3*b* is electrically connected to the power supply circuit at the same time that the motor 3*b* is installed in the holder frame 3*c*.

The motor 3*b* can subsequently be detached from the holder frame 3*c* by spreading apart the fingers 3*f* outwardly and pulling the attachment 3*d* away from the holder frame 3*c*.

As with the attachment structure 3, the attachment structure 4 allows the motor 4*b* to be easily attached to and detached from the chassis 1*b*.

The casing 4*h*, which is integral with the attachment 4*d* of the attachment structure 4, is securely joined to the air duct 4*i*, thus guiding an air flow produced by the hovering fan 4*a* downwardly of the chassis 1*b*.

As shown in FIG. 6A, when the body 1*a* is mounted on the chassis 1*b*, the engaging member end 5*f* of the body 1*a* engages the movable contact 5*d*, laterally shifting the movable contact 5*d* into contact with the fixed contact 5*d*. As a result, the electric energy of the batteries 5*a* can be supplied through the power wire 5*g* to the motors 3*b*, 4*b*.

As shown in FIG. 6B, when the body 1*a* is dismounted from the chassis 1*b*, the engaging member end 5*f* is spaced from the movable contact 5*d*, which springs back out of contact with the fixed contact 5*e*. As a consequence, the motors 3*b*, 4*b* are disconnected from the batteries 5*a* and hence de-energized.

The air-cushion vehicle toy 1 is used as follows:

When the toy 1 is placed on a surface such as a surface of water and the control switch 5*c* is shifted to the "HOVER" position, the motor 4*b* for the hovering fan 4*a* is energized, and the hovering fan 4*a* is rotated. Air under pressure is now delivered by the hovering fan 4*a* through the air duct 48 into the open space 7*d* below the chassis 1*b*. Since the space 7*d* is closed at its lower side by the surface on which the toy 1 is placed, most of the air supplied from the air duct 48 fills up the open space 7*d*. A portion of the air is also sent through the opening 7*c* into the skirt 1*c* itself, inflating the skirt 1*c* downwardly into a substantially doughnut shape. The space 7*d* now functions as a pressure chamber or a floating force generating chamber. When the pressure of the air filled in the open space 7*d* increases in excess of a predetermined pressure, there is developed a floating force which is large enough to float or hover the toy 1. At the same time, the air filled in the skirt 1*c* itself is ejected through the small holes 7*e* downwardly toward the surface on which the toy 1 is placed.

The air which is ejected downwardly from the small holes 7*e* is effective either to lift aloft the toy 1 when the skirt 1*c* is in contact with the surface on which the toy 1 is placed, or to generate an air curtain layer which shields the air flowing downwardly from the space 7*d* when the toy 1 has already been lifted aloft and the skirt 1*c* is spaced from the surface over which the toy 1 is hovering. More specifically, when the toy 1 is lifted aloft, the air ejected from the small holes 7*e* produces an air layer of relatively high pressure between the lower surface of the skirt 1*c* and the surface over which the toy 1 is hovering. The high-pressure air layer surrounds the open space 7*d* when viewed in plan. Therefore, the air under pressure in the space 7*d*, which serves as a floating force generating chamber, is prevented from locally leaking out of the space 7*d*. As a result, the generated floating force is well balanced, and free of localized intensity variations. The air curtain layer has a certain width in the radially outward direction, which is also effective in preventing the air under pressure in the space 7*d* from locally leaking out of the space 7*d*. Since the small holes 7*e* are disposed closely to the center of the bottom of the skirt 1*c*, i.e., near the open space 7*d*, the air ejected from the small holes 7*e* also serves to effectively increase the air pressure in the space 7*d*.

The rotatable shaft of the motor 4*b* on which the hovering fan 4*a* lies horizontally. Therefore, while the toy 1 is floating, no yawing acceleration is produced by the hovering fan 4*a*, and hence the toy 1 remains directionally stable.

When the control switch 5*c* is shifted to the "HOVER/RUN" position, the motor 3*b* for the propeller fan 3*a* is also energized in addition to the motor 4*b*, so that the propeller fan 3*a* is also rotated. When the propeller fan 3*a* is rotated, air is introduced into the cover 1*a* through the air inlet hole 2*h* and ejected rearwardly through the air outlet hole 2*i*, thus propelling the toy 1. The direction in which the toy 1 is propelled is determined by the steering rudder 2*j*.

When the control switch 5*c* is shifted to the "STOP" position, the motors 3*b*, 4*b* are de-energized, and the fans 3*a*, 4*a* are stopped. Therefore, the toy 1 is neither hovered nor propelled. If the toy 1 is placed on water, the toy 1 stably floats on the water surface due to the buoyancy of the float 6*a*.

With the air-cushion vehicle toy 1 according to the present invention, when the body 1*a* is removed from the chassis 1*b* for battery replacement, motor replacement, or other servicing, the motors 3*b*, 4*b* are forcibly de-energized by the power cutoff mechanism 5. Therefore, the motors 3*b*, 4*b* are effectively prevented from being energized by mistake during such servicing operation.

Since the motor attachment structure 3 is constructed of only the holder frame 3*c* and the attachment 3*d*, the number of required parts is small. Because the attachment 3*d* can easily manually be attached to the holder frame 3*c*, the motor 3*b* can easily be installed on the chassis 1*b*. It is not necessary to use tools such as a screwdriver when the motors are to be replaced for the modification of the toy 1. As a result, the motor attachment structure 3 is low in cost. The attachment 3*d* is larger than screws and other small-size fastening elements and has a noncircular shape, the attachment 3*d* is less liable to be lost or roll away when detached from the holder frame 3*c*. The above advantages hold true for the motor attachment structure 4. In addition, since the casing 4*h* for the fan 4*a* is integral with the attachment 4*d*, the casing 4*h* can be attached in place at the same time that the motor 4*b* is installed on the chassis 1*b*. The motor 4*b* is therefore also easy to install on the chassis 1*b*.

When the air-cushion vehicle toy 1 is floating, the air pressure in the space 7*d* is presented from locally leaking out of the space 7*d* by an air curtain which is established by air ejected from the small holes 7*e*. Accordingly, the air under pressure which is confined in the space 7*d* is effective to produce a well-balanced downward air thrust or floating forces. The air-cushion vehicle toy 1 as it floats is thus prevented from being tilted, by a relatively simple construction.

The principles of the present invention are also applicable to a remotely controlled air-cushion vehicle toy.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

What is claimed is:

1. An air-cushion vehicle toy comprising:

a chassis;

a propeller fan mounted on said chassis;

a first motor mounted on said chassis, for driving said propeller fan;

a hovering fan mounted on said chassis;

a second motor mounted on said chassis, for driving said hovering fan;

a power supply mounted on said chassis and selectively connectable to said first motor and said second motor, for energizing the first motor and the second motor, said power supply and said first and second motors constituting a power supply circuit;

a body detachably mounted on said chassis in covering relation to said propeller fan, said first motor, said hovering fan, said second motor, and said power supply; and a power cutoff mechanism disposed in said power supply circuit, for breaking said power supply circuit to de-energize said first and second motors, when said body is removed from said chassis, and for making said power supply circuit when said body is attached to said chassis.

2. An air-cushion vehicle toy according to claim 1, wherein said power cutoff mechanism comprises a fixed contact fixed to said chassis, a movable contact disposed in said power supply circuit and normally spaced from said fixed contact, and an engaging member end attached to said body, and wherein said engaging member end is engageable with said movable contact to bring said movable contact into contact with said fixed contact, thereby making said power supply circuit, when said body is attached to said chassis.

3. An air-cushion vehicle toy according to claim 1, further comprising:

a first motor attachment structure by which said first motor is installed on said chassis; and a second motor attachment structure by which said second motor is installed on said chassis;

said first motor attachment structure comprising a first holder frame mounted on said chassis and accommodating said first motor, said first holder frame having at least one recess, and a first attachment attached to said first holder frame to secure said first motor and having at least one resilient finger which resiliently engages in said recess in said first holder frame;

said second motor attachment structure comprising a second holder frame mounted on said chassis and accommodating said second motor, said second holder frame having at least one recess, and a second attachment attached to said second holder frame to secure said second motor and having at least one resilient finger which resiliently engages in said recess in said second holder frame.

4. An air-cushion vehicle toy according to claim 3, wherein said first attachment has a resilient tooth resiliently held against said first motor to press the first motor against said first holder frame, and said second attachment has a resilient tooth resiliently held against said second motor to press said second motor against said second holder frame.

5. An air-cushion vehicle toy according to claim 3, wherein said second motor attachment structure includes a casing integral with said second attachment and surrounding said hovering fan.

6. An air-cushion vehicle toy according to claim 1, further comprising:

a skirt mounted on a lower surface of said chassis;

said skirt defining a pressure space for ejecting downwardly of the toy part of air under pressure delivered by said hovering fan;

said skirt having a plurality of holes for ejecting the remainder of the air under pressure delivered by said hovering fan, said holes being defined in a lower surface thereof and arranged in surrounding relation to said pressure space when viewed in plan.

7. An air-cushion vehicle toy according to claim 6, wherein said skirt has an opening for introducing said remainder of the air under pressure into the skirt itself so as to guide said remainder of the air under pressure toward said holes;

said skirt comprising a bag of thin film made of soft resin, so that said skirt is inflatable downwardly when said remainder of the air under pressure is introduced into said skirt through said opening.

* * * * *